United States Patent [19]

Kreyenhop

[11] Patent Number: 4,542,781

[45] Date of Patent: Sep. 24, 1985

[54] BREAKOUT WARNING METHOD, UTILIZING ACOUSTICS, IN A CONTINUOUS CASTING INSTALLATION AND APPARATUS FOR ITS IMPLEMENTATION

[75] Inventor: Manfred Kreyenhop, Bremen, Fed. Rep. of Germany

[73] Assignee: Klöckner-Werke Aktiengesellschaft, Duisburg, Fed. Rep. of Germany

[21] Appl. No.: 568,069

[22] Filed: Jan. 4, 1984

[30] Foreign Application Priority Data

Jan. 7, 1983 [DE] Fed. Rep. of Germany ..... 3300327

[51] Int. Cl.[4] ..... B22D 11/16

[52] U.S. Cl. ..... 164/451; 164/452; 164/150

[58] Field of Search ..... 164/451, 452, 454, 150, 164/413, 154

[56] References Cited

U.S. PATENT DOCUMENTS

| | | | |
|---|---|---|---|
| 3,456,715 | 7/1969 | Freedman et al. | 164/413 X |
| 3,786,856 | 1/1974 | Nishikawa | 164/454 X |

FOREIGN PATENT DOCUMENTS

| | | | |
|---|---|---|---|
| 55-97857 | 7/1980 | Japan | 164/452 |
| 56-89356 | 7/1981 | Japan | 164/452 |
| 57-152356 | 9/1982 | Japan | 164/451 |

*Primary Examiner*—Nicholas P. Godici
*Assistant Examiner*—Kenneth F. Berg
*Attorney, Agent, or Firm*—Watson, Cole, Grindle & Watson

[57] ABSTRACT

A breakout warning method and apparatus for a continuous casting installation wherein structure-bound sound, traveling through the area of the ingot mold, is continuously picked up by a sound recorder and checked for the presence of typical frictional noises between the mold and billet. A breakout signal is emitted upon determination that there are no typical frictional noises present.

14 Claims, 2 Drawing Figures

BREAKOUT WARNING METHOD, UTILIZING ACOUSTICS, IN A CONTINUOUS CASTING INSTALLATION AND APPARATUS FOR ITS IMPLEMENTATION

BACKGROUND OF THE INVENTION

1. Field of the Invention

The invention relates to a breakout warning method in a continuous casting installation in which measurements are taken in the area of an ingot mold and changes in the measuring results are monitored by an apparatus operating according to such method.

2. Description of the Prior Art

In a manner known from prior art continuous casting installations, liquid steel is cast from a distributing unit into a water-cooled ingot mold, usually a copper mold. This mold is reciprocated at a frequency of approximately 1.5 Hz in the direction of travel of the continuous casting. Normally, between the poured steel billet and the ingot mold a lubricating film is maintained which is obtained from a lubricating substance specially provided therefor. As is known, an outer jacket of the charged liquid steel solidifies in the mold so that it acquires a certain strength. The poured steel billet or ingot can thereby support itself at the bottom of the mold and can be pulled out continuously from the mold.

During the practical operation of such a continuous casting installation, unpredictable breakdowns occur from time to time during which the outer jacket of the billet ruptures in an undesirable fashion resulting in a "breakout." This is attributable to the formation of bakings between the cast-on steel and the mold which cause the steel jacket that has already solidified and supports the billet to burst within the mold. If this burst spot does not acquire adequate strength again by cooling before the liquid steel leaves the mold, the steel will "breakout" and flow into the installation, disturbing the production run.

The baking referred to above is a solidified mass of steel permanently bonded to at least one wall of the mold. In the mold the outer shell of the strand continuously solidifies and leaves the mold when the shell thickness is sufficient, i.e., when the strand is self-supporting. If the shell of the strand is not thick enough, it may rupture or re-liquify. Molten steel then pours out without forming a strand. Normally a baking does not entirely block the mold to stop the flow of metal, but only a local baking occurs. This is worse than a total blocking. Local bakings change the flow characteristics of molten steel in the mold and thus prevent the formation of a sufficiently stable shell.

A prior breakout warning method is well known as a result of experiments during which the hoisting speed of the mold is measured and changes in the speed are monitored. This method does not always work satisfactorily.

SUMMARY OF THE INVENTION

The primary object of the invention is to further develop prior art methods and devices to achieve an early detection of a breakout while avoiding any objectionable features, so that an imminent breakout is detected with a high degree of certainty. In the process according to the invention, a breakout warning signal is emitted sufficiently early to cope with the dangerous situation created by the breakout and sufficiently early to reduce disturbances, particularly bakings, that have already occured. This object is achieved by measuring the sound of the casting operation appearing in the area of the ingot mold. The sound is continuously picked up by a sound recorder and compared with a normal sound signal in a comparator circuit. More particularly, a sound signal picked up shortly before and previously recorded by the sound recorder and then stored is compared with an instantaneous sound signal. A breakout signal is emitted when the actual or instantaneous sound signal differs from the normal sound signal by more than a predetermined threshold value. A sound recorder, more particularly a hydrophone,is arranged in the area of the ingot mold and an amplifier is connected to the sound recorder. A comparator circuit and an alarm device are also used to generate the breakout warning signal.

When a breakout first occurs, a lubricating film between the mold and the steel moving therethrough is interrupted so that at first relatively loud grinding frictional noises occur. When a baking starts to form, grinding noises between the mold and the steel strand at first increase, as in this stage the lubricating film between mold and the steel strand disappears and the strand directly scratches along the mold. This gives rise to a more rapid cooling than desired, leading to the formation of a local baking. During the formation of this local baking the grinding noises decrease, as the baking does not move relative to the mold. The steel bath thus forms a permanent bonding or baking with the wall of the mold. A surprising finding was that these physical events can be measured and proved acoustically, processed, and utilized for the emission of a breakout warning signal.

During normal operation, the continuous casting installation emits typical grinding noises which are produced by the movement between the mold and the steel that has just solidified, during which the mold, as frequently happens, can be reciprocated, but it can also rest. It is possible to measure or monitor only an increase of the grinding noises, that is, to record the instant when the lubricating film is interrupted locally, or to record the time of the subsequent drop of the grinding noises or to record both events. Because of the greater amount of information available for processing, the latter measuring procedure has the lowest failure or error rate and is therefore preferred. It should be emphasized that either the initial increase of the grinding noises or the subsequent drop thereof is sufficient to detect a breakout. The frequencies at which the increase of the grinding noises are observed following rupture of the lubricating film and the drop of the grinding noises after the formation of the first bakings can be altogether different. Perferably, however, the same frequency range is recorded for both noises.

Problems arise when carrying this method into practice, because near the mold there are other units that produce a great deal of noise. Thus, the grinding noises must be filtered out of a ground level of other noises, such as water-flow noises, crane noises, and noises of the roller table of the continuous casting installation. According to the invention, this filtering is done by picking up the grinding noises with a sound recorder at a point where they are relatively loud. A hydrophone, that is, a submerged microphone, is placed in the area of the cooling water of the mold, for example, within the mold proper, in its inlet pipe or in its discharge pipe. Moreover, acceleration pickups have also proved to be suitable that are connected mechanically to the mold and in particular, connected so as to record structure-bound sound.

Advantageously, sound recorders are arranged on several sides of the mold, preferably on all four sides, because the bakings usually start locally. According to the invention, the readout of the desired signal of the grinding noises occurs in a comparator circuit which preferably includes a frequency analyzer and a computer. The comparator circuit verifies whether the sound signal actually or instantaneously recorded differs from an earlier recorded normal sound signal, with the measurements being carried out in a narrow frequency range, for example, several hertz. It is assumed that the other sound signals remain substantially constant and, preferably, only the grinding noise possessing the desired information content is subject to change. Since there are always fluctuations between the actually measured sound signal and the normal or reference sound signal, only deviations from the normal sound signal that exceed or drop below a certain threshold value will result in a breakout warning signal.

It has been shown to be of great advantage to selectively design a downstream amplifier and evaluator circuit within the frequency range that is particularly dominant between the mold and the solidified metal skin. The evaluator circuit incorporates the amplifier for the microphone, a comparator to which the actual signal of the microphone and an earlier obtained reference signal are fed and a level detector giving an output signal, if the output of the comparator is greater than a fixed threshold value. During tests, it was demonstrated that the frequency of the frictional noises varied from installation to installation depending upon the steel. By way of example, a difference such as a reduction in the grinding noises could be noted within a range of approximately 3 KHz.

Experiments have shown that only about 30 seconds are available between the emission of the breakout warning signal and the actual breakout. Owing to this brief time span, it is advisable to automatically trip operations with the breakout warning signal in the control strand of the continuous casting installation to stop or repair the breakout that has already begun. This can be effected by briefly stopping the billet, slowing it down, or increasing the cooling in the mold. An acoustic breakout warning signal may also be emitted along with or instead of the automatic trip signal. It should be noted, however, that the time available or remaining to prevent the breakout, once it starts, is relatively short.

BRIEF DESCRIPTION OF THE DRAWINGS

Various other objects, features and attendant advantages of the present invention will be more fully appreciated as the same becomes better understood from the following detailed description when considered in connection with the accompanying drawings, in which like reference characters designate like or corresponding parts through the several views and wherein.

DETAILED DESCRIPTION OF THE PREFERRED EMBODIMENTS

Figure 1:
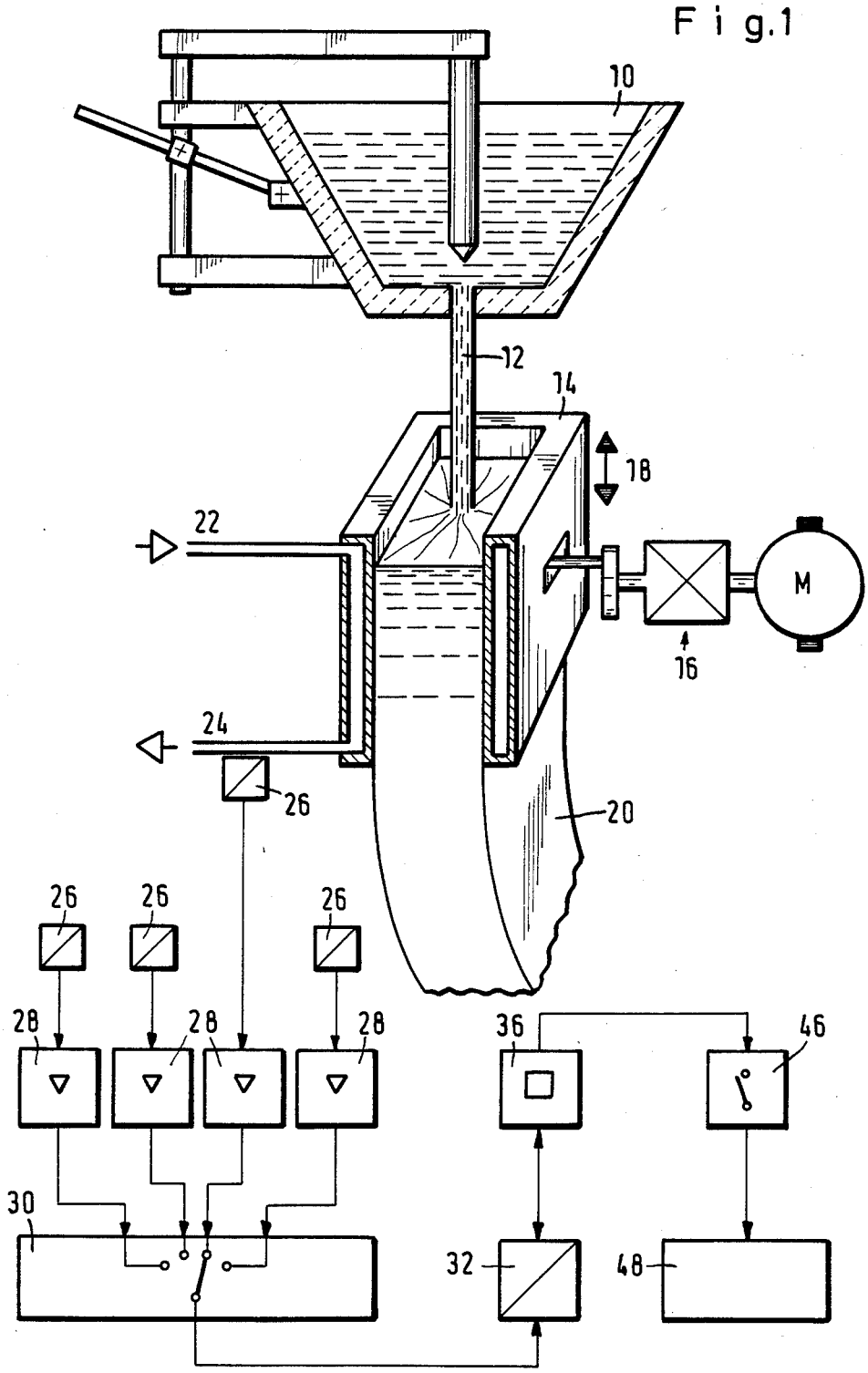
FIG. 1 is a basic schematic diagram of a continuous casting installation provided with a launder or casting ladle, rinsing water pipe, and breakout warning apparatus wherein only one of the four cooling water pipes is shown for clarity.

As can be appreciated from FIG. 1, a liquid steel jet 12 flows from a launder 10 into a mold 14, which is reciprocated by a motion system at a frequency of approximately 1.5 Hz in the direction of double arrow 18. Motor M drives actuating unit 16 to effect reciprocation. The outer jacket of the poured steel solidifies in mold 14, so that the steel can essentially support itself and issue as billet 20 from the lower part of mold 14. Mold 14 is constructed in a known fashion as a copper mold and, as shown in the drawing, it is hollow so that cooling water can flow therethrough. The cooling water travels via inlet pipe 22 to the sealed interior of mold 14 and issues therefrom via discharge pipe 24.

Figure 2:
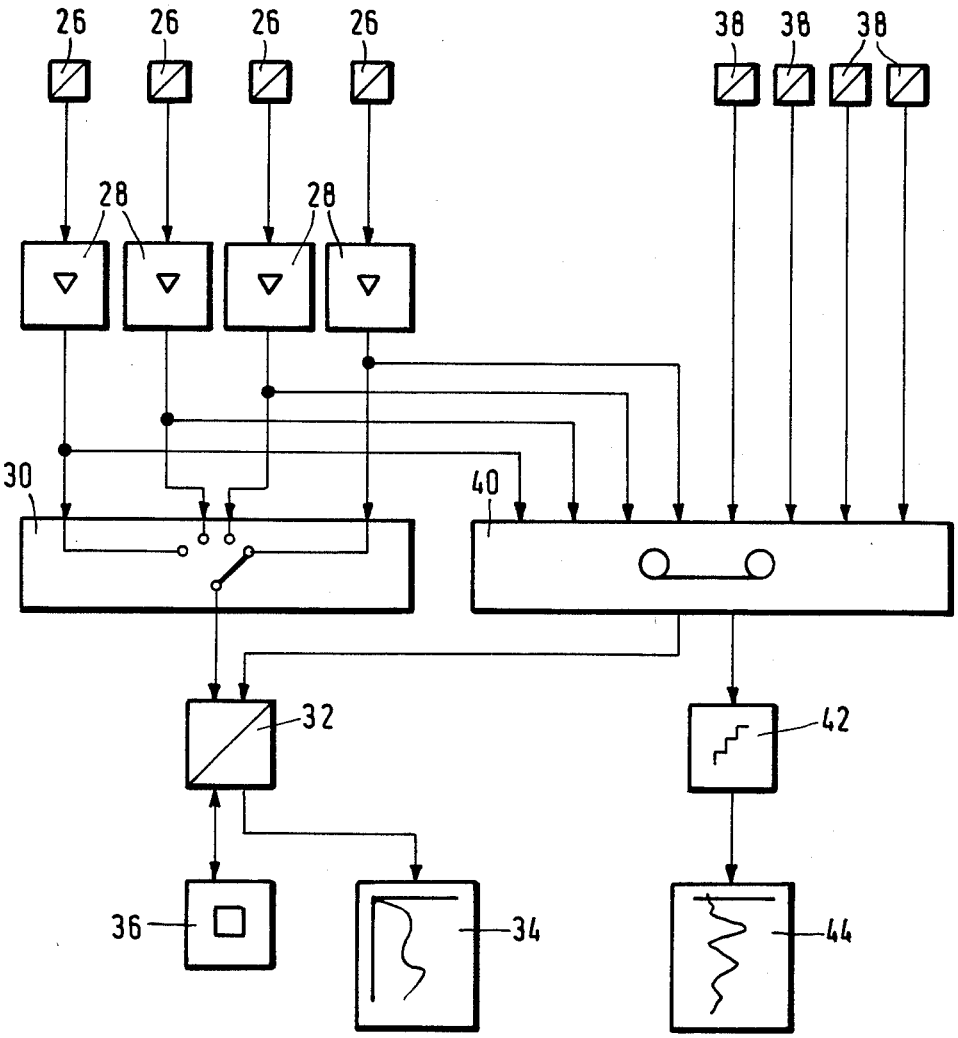
FIG. 2 is a diagram of the detector system.

To the outer wall of discharge pipe 24 and spaced a given optimized distance from mold 14 there is attached a sound recorder 26. Sound recorder 26 measures the sound of the billet or ingot 20 passing through mold 14 and may take the form of an acceleration pickup connected to charge amplifier 28. The signal actually monitored and instantaneously picked up by sound recorder 26 is continuously recorded by a recorder 40 such as a tape recorder. The signal also may be recorded by a strip chart recorder 44 as shown in FIG. 2. The frequency of a comparator circuit which includes comparator 32 and computer 36 is so designed that it particularly evaluates the frictional frequencies between billet 20 and mold 14. Comparator 32 may include a narrow band frequency analyzer or a permanently set filter. If necessary, a filter 42 can be disposed downstream of charge amplifier 28 to suppress unwanted frequencies, to eliminate parasitic voltages and radio interferences so as to smooth the writing of strip chart recorder 44. Switch 30 may be provided to selectively monitor one of a total of four local microphones 26. A strip chart recorder 34 may be connected to comparator 32 as shown. A plurality of microphones 38 may be connected to recorder 40 to sense unspecific background noises which are produced at the same time as the grinding noise.

The signal actually picked up by sound recorder 26 and amplified by charge amplifier 28 is routed to the comparator circuit 32,36 and compared thereat to a comparative normal sound signal which serves as a reference signal. The comparative or reference signal is taken during normal operation without bakings and recorded or sent to a time-delay circuit. The signal from microphone 26 may be branched to comparator 32 in two signals, one signal is timely delayed for certain seconds and compared with the other undelayed signal. Only those signals which exceed a certain threshold value compared to the reference signal should give rise to a warning signal.

The normal or reference sound signal is picked up during the interference-free operation and stored in comparator circuit 32,36 to form delayed reference sound signals. When the instantaneously picked up and filtered actual sound signal exceeds a first predetermined threshold value above the delayed reference or normal signal for approximately two seconds and/or the instantaneously picked up and filtered actual sound signal falls below a second predetermined threshold value below the delayed reference or normal signal for approximately two seconds or longer, this is an indication that baking is taking place. In this case, a warning signal is immediately generated by alarm unit 46 and transmitted to installation 48. Installation 48 is stopped automatically for a brief period to stop or slow down billet 20 to allow its ruptured jacket to close. After this brief period, installation 48 is started anew slowly. The continuous casting installation will not be damaged by a false alarm whereby it is unnecessarily stopped. Strand 20 is not necessarily stopped if installation 48 is stopped. It may be sufficient to increase spray cooling of the strand or increase the water supply to the mold in case of a warning signal.

The useful sound signals are processed and evaluated in a computer 36 because, depending on various parameters such as the type of steel and casting speed, the principal frequency and amplitude of the frictional noises can vary slightly. The accuracy of evaluation is enhanced by a computer in relation to a permanently set filter. That is, signal processing may be either performed by a permanently set filter or a computer. A computer is more flexible and better adapts to the frequency changes of the grinding noise. Thus, a computer is more reliable than a filter.

Compared with the illustration in the drawings, it was shown to be of great advantage not to couple the sound recorder 26 mechanically so as to directly receive a structure-bound sound, but to design it as a hydrophone and to submerge it in the cooling water, in discharge pipe 24, or even in the cooling water space of mold 14.

Finally, in the case of a reciprocating mold, it is of great advantage to periodically record the grinding noises in step with the frequency of motion of mold 14. By a lock-in amplifier or another signal averager, signals that are not generated in step with the frequency of motion of the mold are averaged out.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A method for producing a breakout warning signal in a continuous casting installation wherein billets are formed within a continuous casting mold, said method using a sound recorder, storage means and comparator means, and wherein said method comprises:

continuously measuring instantaneously actual sound signals around said mold with said sound recorder during operation of said mold;

storing and delaying said actual sound signals within said storage means to form delayed reference sound signals;

sending said delayed reference sound signals to said comparator means;

sending instantaneously said actual sound signals to said comparator means for comparison with said delayed reference sound signals; and generating said breakout warning signal upon detecting with said comparator means a difference greater than at least one predetermined threshold value between said instantaneously sent actual sound signals and said delayed reference sound signals.

2. The method of claim 1, wherein said actual sound signals comprise grinding noise signals generated between said billets and said mold and wherein said measuring comprises measuring within a frequency range wherein a presence of said grinding noise signals are maximized and wherein other background noises are minimized.

3. The method of claim 1, wherein said breakout warning signal is generated upon said instantaneously sent actual sound signals rising above said delayed reference sound signals by a value greater than said at least one predetermined threshold value.

4. The method of claim 1, wherein said breakout warning signal is generated upon said instantaneously sent actual sound signals falling below said delayed reference sound signals.

5. The method of claim 1, wherein said breakout warning signal is generated upon said instantaneosly sent actual sound signals rising above said delayed reference sound signal by at least one predetermined threshold value and then falling below said delayed reference sound signals.

6. The method of claim 1 which further comprises generating said breakout warning signal after first detecting an increase in said instantaneously sent actual sound signals above said delayed reference sound signals by an amount greater than a first predetermined threshold value and then detecting a decrease in said instantaneously sent actual sound signals below said delayed reference sound signals by an amount greater than a second predetermined threshold value.

7. The method of claim 1, wherein said ingot mold comprises cooling water flowing therethrough, wherein said sound recorder comprises a hydrophone, and wherein said measuring further comprises measuring sound signals within said cooling water with said hydrophone.

8. The method of claim 1, wherein said measuring further comprises measuring structure-bound sound traveling within said ingot mold.

9. The method of claim 1, wherein said ingot mold comprise a waste water pipe and wherein said measuring further comprises measuring structure-bound sound within said waste water pipe.

10. The method of claim 1, wherein said method further comprises transmitting said breakout warning signal to an installation to prevent an imminent breakout.

11. The method of claim 10, wherein said billet travels through said mold at a predetermined casting speed and wherein said method further comprises preventing an imminent breakout by changing said predetermined casting speed of said billet through said mold.

12. The method of claim 10 which further comprises automatically controlling said installation with said breakout warning signal to prevent said imminent breakout.

13. An apparatus for producing a breakout warning signal in a continuous casting installation wherein billets are formed within a continuous casting mold, said apparatus comprising:

a sound recorder arranged adjacent said mold for recording casting sounds;

an amplifier connected to said sound recorder for amplifying said casting sounds;

comparator means connected to said amplifier for comparing said casting sounds; and alarm means connected to said comparator means for generating said breakout warning signal.

14. The apparatus of claim 13 wherein said comparator means comprises a narrow band frequency analyzer and a computer.

* * * * *